United States Patent [19]

Ghosh et al.

[11] Patent Number: 4,680,558

[45] Date of Patent: Jul. 14, 1987

[54] CORRUGATED TRANSITION DEVICE FOR USE BETWEEN A CONTINUOUS AND A CORRUGATED CIRCULAR WAVEGUIDE WITH SIGNAL IN TWO DIFFERENT FREQUENCY BANDS

[75] Inventors: Subir Ghosh; Aluízio P. Junior, both of Sao Paulo, Brazil

[73] Assignee: Telecomunicacoes Brasileiras S/A - Telebras, Brasilia, Brazil

[21] Appl. No.: 776,167

[22] PCT Filed: Dec. 27, 1984

[86] PCT No.: PCT/BR84/00007

§ 371 Date: Sep. 5, 1985

§ 102(e) Date: Sep. 5, 1985

[87] PCT Pub. No.: WO85/02945

PCT Pub. Date: Jul. 4, 1985

[30] Foreign Application Priority Data

Dec. 27, 1983 [BR] Brazil ..... 8307286[U]

[51] Int. Cl.[4] ..... H01P 1/16; H01P 5/08

[52] U.S. Cl. ..... 333/21 R; 333/242; 333/251

[58] Field of Search ..... 333/239, 242, 251, 21 R, 333/21 A

[56] References Cited

U.S. PATENT DOCUMENTS

| | | | |
|---|---|---|---|
| 2,866,595 | 12/1958 | Marie . | |
| 3,413,642 | 11/1968 | Cook | 333/21 R X |
| 3,838,362 | 9/1974 | Kurtz . | |
| 4,048,592 | 9/1977 | Drabowitch . | |
| 4,367,446 | 1/1983 | Hall . | |
| 4,439,748 | 3/1984 | Dragone | 333/239 |
| 4,520,329 | 5/1985 | Cavalieri D'Oro et al. . | |

FOREIGN PATENT DOCUMENTS

| | | |
|---|---|---|
| 2525358 | 10/1976 | Fed. Rep. of Germany . |
| 2455803 | 11/1980 | France . |
| 56-2702 | 1/1981 | Japan . |
| 1498905 | 1/1978 | United Kingdom . |

OTHER PUBLICATIONS

Ghosh et al., "*Simplified High-Performance Dual-Band Feed Comprising a Dual-Depth Corrugated Launcher, Etc.*", Electronics Letters, Jun. 21, 1984, pp. 532–533.

13th European Microwave Conference, Sep. 5–8, 1983, A. D. Olver et al., "Dual Depth Corrugated Horn Design", pp. 879–884.

AP-S International Symposium, 1980, IEEE, vol. 1, S. Ghosh, "A Corrugated Wave Guide Feed for Discrete Multi-Bank Applications Having Dual Dept Corrugations, pp. 217–220.

Electronics Letters, V. 18, No. 20, Sep. 30, 1982, S. Ghosh, "Hybrid-Mode Feed for Multiband Applications Having a Dual Depth Corrugation Boundary", pp. 860–862.

G. L. James et al., "$Te_{11}$ to $He_{11}$ Cylindrical Waveguide Mode Converters Using Ring-Loaded Slots, IEEE Trans., vol. MTT-30, No. 3, Mar. 1982.

*Primary Examiner*—Paul Gensler

*Attorney, Agent, or Firm*—Finnegan, Henderson, Farabow, Garrett & Dunner

[57] ABSTRACT

A transition device achieves transformation of the signal carrier mode of a continuous wave guide, into the hybrid mode, the corresponding mode for carrying signals in corrugated structures, by employing a tapered waveguide transition of circular cross-section having dual-depth circumferential slots in the interior boundary surface thereof. The transition device utilizes a mutual resonance property of the slots at the port which connects to a continuous waveguide to achieve satisfactory operation in two frequency bands. At the port which is connected to a corrugated horn, the quarter wavelength self resonance of the individual slots provides the desired hybrid mode under balanced hybrid condition in these two bands. A gradual transition of the electrical characteristics is achieved along the length of the transition device through an adjustment of slot dimensions. Excitation of higher order spurious modes is maintained at a low level when properly chosen cross-sectional dimensions are considered along the length of the transition device.

9 Claims, 3 Drawing Figures

CORRUGATED TRANSITION DEVICE FOR USE BETWEEN A CONTINUOUS AND A CORRUGATED CIRCULAR WAVEGUIDE WITH SIGNAL IN TWO DIFFERENT FREQUENCY BANDS

BACKGROUND OF THE INVENTION

I. Field of the Invention

This invention relates to a device for propagating signals between a continuous and a corrugated circular waveguide with minimized mismatch and low spurious mode excitations in two bands of frequency realized through a special inner boundary configuration in the transition which consists of dual-depth corrugations with changing dimensions along the length thereof.

II. Background Information

It is well known, satellite communication systems operate through the use of two distinct and well defined frequency bands where the higher frequency band (uplink) carries signals from the earth stations to the satellite while signals are sent from the satellite towards the earth stations in the lower frequency band (downlink). For such applications with certain stringent electrical specifications imposed on the radiation characteristics of the operating antennas, a corrugated horn feeding the reflector antenna system is considered to be one of the optimum solutions. This arrangement achieves satisfactory efficiency while maintaining low sidelobe and cross-polarized radiation levels.

With the introduction of the concept of frequency reuse where better utilization of the available frequency bands through simultaneous propagation of signals via two orthogonal polarizations at the same frequency is considered, the electrical specifications on the antenna characteristics have become furthermore stringent. In order to fulfil these requirements in terms of the cross-polarized radiation characteristics, often a dual-depth corrugated horn is employed which allows very low cross-polarized radiation characteristics to be maintained in two widely separated frequency bands, with an available freedom for adjustment of separation between the two bands.

However, for both the above mentioned applications utilizing a horn with conventional or dual-depth corrugations, the horn is conventionally connected at its throat region to a continuous circular waveguide which constitutes the common transmission line of the feed chain for the uplink as well as the downlink signals. The continuous circular waveguide supports the signals as the dominant TE11 mode. The arrangement calls for a transition to be devised to transform this mode into HE11 hybrid mode that propagates along the corrugated configuration of the horn. There are certain deleterious effects such as high return loss of the signals or unacceptable levels of spurious mode excitation that may accompany the transformation of TE11 to HE11 mode in the transition from a continuous circular waveguide to a corrugated circular waveguide, especially, when such transformation is desired at two widely separated frequency bands simultaneously.

In order that such a transition functions satisfactorily, a high susceptance boundary condition must be simulated near the continuous waveguide end through usage of appropriately configured corrugations which must gradually change their dimensions along the length of the transition to reach a low susceptance boundary condition at the other end where it connects into the horn. The manner of changing the corrugation configuration along the length of transition together with change in cross-section of the transition, is based on certain design criterion which prevents excitation of spurious modes or introduction of return loss at unacceptable levels.

Amongst the known transition for the transformation of TE11 to HE11 modes, there are two principal types which present satisfactory results for many applications. The first and most commonly used type of transition consists of a conventionally corrugated tapered circular waveguide transition where the depth of the corrugations are about half a free space wavelength deep at the highest frequency of operation at the continuous waveguide end, and starting with this value of depth of corrugations, they are diminished in depth gradually along the length of the transition such that about a quarter of a wavelength deep slot at the lowest frequency of operation is achieved at the end connecting into the horn. Such a transition operates with satisfactory electrical characteristics over a single and reasonably broad band. However, such a transition fails to operate satisfactorily when optimized performance is desired in two widely separated bands. The second and the rather involved, in terms of its manufacturing, type of the transition consists of a tapered circular waveguide transition furnished with a special corrugated boundary made of ring loaded corrugations. These ring loaded corrugations have a wider opening at the bottom to achieve broadened band of operation that encompasses the widely separated bands.

In terms of manufacturing, due to the unusual shape of the corrugations, the ring loaded corrugation configuration presents many difficulties. Since conventional machining techniques cannot be used to make such corrugations, they must be either configured with discs or electroformed on a mandrel which is later removed by chemical dissolving. Needless to emphasize, such methods of manufacturing call for considerable amount of effort and cost in production. Of course, in terms of the electrical performance, this second type of transition can potentially achieve the desired specification far more satisfactorily than the first type discussed before.

SUMMARY OF THE INVENTION

With the above described background on the state of the art on the design of the transitions between continuous and corrugated circular waveguides which operate in two separated frequency bands, the objective of this invention has, therefore, been to develop an efficient dual-band transition between a continuous and a corrugated circular waveguide which is, at the same time, a sufficiently simple configuration that can be manufactured by conventional machining techniques.

The present invention is a transition in circular cross-section with its inner boundary wall furnished with circumferential dual-depth corrugations which allow efficient transformation of TE11 mode of a continuous circular waveguide into HE11 mode of a corrugated circular waveguide for two widely separated bands of frequencies. Hereafter the invention will be referred to as "dual-depth corrugated transition" or simply DDCT. The corrugations in the DDCT are formed by a plurality of circumferential slots which are classified into two distinct types in terms of the differences in the relative depth and sometimes also the width of the slots. These two types of slots are interspread between themselves so that in the resulting corrugated configuration, successive slots are of different types while alternate slots are of a common type. At that end of the DDCT which connects into the horn, the two types of slots are optimized in their depths in such a way that each one of them is in quarter wavelength self resonance at different frequencies which are assigned to belong, one each, to the two separated bands of interest. As a result of this, each self resonant slot presents a low susceptance in the band where its resonant frequency is located while the adjacent non-resonant slot contributes very little towards determinning the net susceptance boundary condition. Hence, a net low susceptance boundary condition is suitably simulated in two bands simultaneously to support HE11 mode at that end of the DDCT which connects to the horn. Whereas, at the end of the DDCT connnecting with the continuous waveguide, the two types of slots are given certain amount of increased depths such that at the two pre-assigned frequencies which belong to the two bands of interest, the adjacent slots of two distinct types are in mutual resonance to give a resultant high susceptance boundary condition in the two bands simultaneously. The mutual resonance between the adjacent slots is caused by placement of their individual susceptances in such a way that they are comparable in magnitude but opposite in sign, i.e, one is capacitive and the other is inductive. In this way, the desired high susceptance boundary condition is simulated in the continuous waveguide end of the DDCT to achieve satisfactory matching condition for the TE11 mode at two frequency bands simultaneously. Finally, along the length of the DDCT a gradual change in dimension, predominantly the depth and sometimes also the slotwidth and corrugation wall thickness, for both types of corrugation slots is considered to incorporate a gradual change of boundary condition between the two ends.

BRIEF DESCRIPTION OF THE DRAWINGS

The invention is illustrated in and further described with reference to the accompanying FIGS. 1 to 3 in which.

DESCRIPTION OF THE PREFERRED EMBODIMENT

Figure 1:
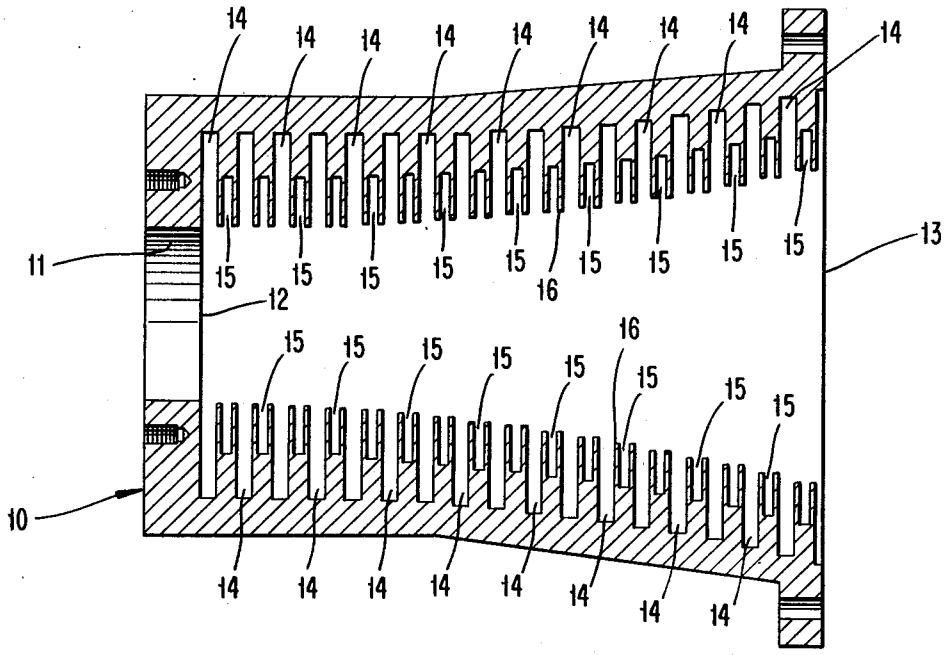
FIG. 1 shows a cross-sectional view of the DDCT consisting of dual-depth corrugations with changing depth of slots along the length of the structure.

Refering to the FIG. 1, the DDCT consists of a metal body 10 which has an internal circular cross-section surface with a plurality of corrugation forming slots, 14 and 15. The annular irises 16 separate the slots, 14 and 15, to create a corrugation boundary of the DDCT in which the slots are classified into two types: one series of slots, referenced 14, have greater depth and a certain width while the second series of slots, referenced 15, have a relatively smaller depth and optionally a different width also. The plurality of the above mentioned two types of slots are alternately positioned to give rise to a dual-depth corrugation boundary where the successive slots are of the different type, i.e, 14 and 15; while the alternate slots are of a common type, i.e., 14 and 14 or 15 and 15. Furthermore, along the length of the DDCT between the ports 12 and 13, the dual-depth corrugation boundary undergoes a continuous dimensional change, predominantly, in terms of the depth of slots; although, in some cases, the change may also include variation in the width of slots or the width of irises. The port 12 of the DDCT is connected to a continuous circular waveguide 11; whereas, port 13 is connected to the throat of a horn (not shown in figure).

Figure 2:
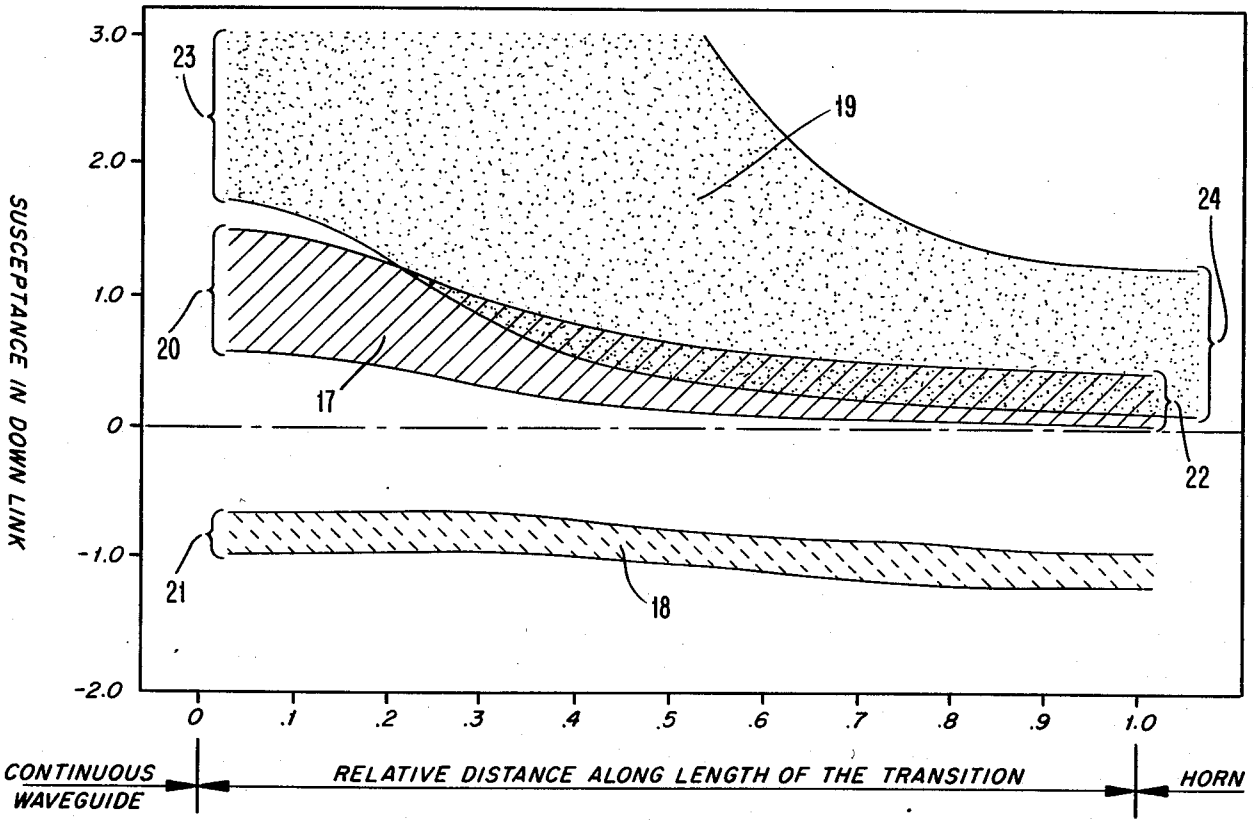
FIG. 2 shows the susceptance of the individual corrugation slots, which constitute the dual-depth corrugations, and the resultant simulated susceptance at the downlink along the length of the DDCT.
Figure 3:
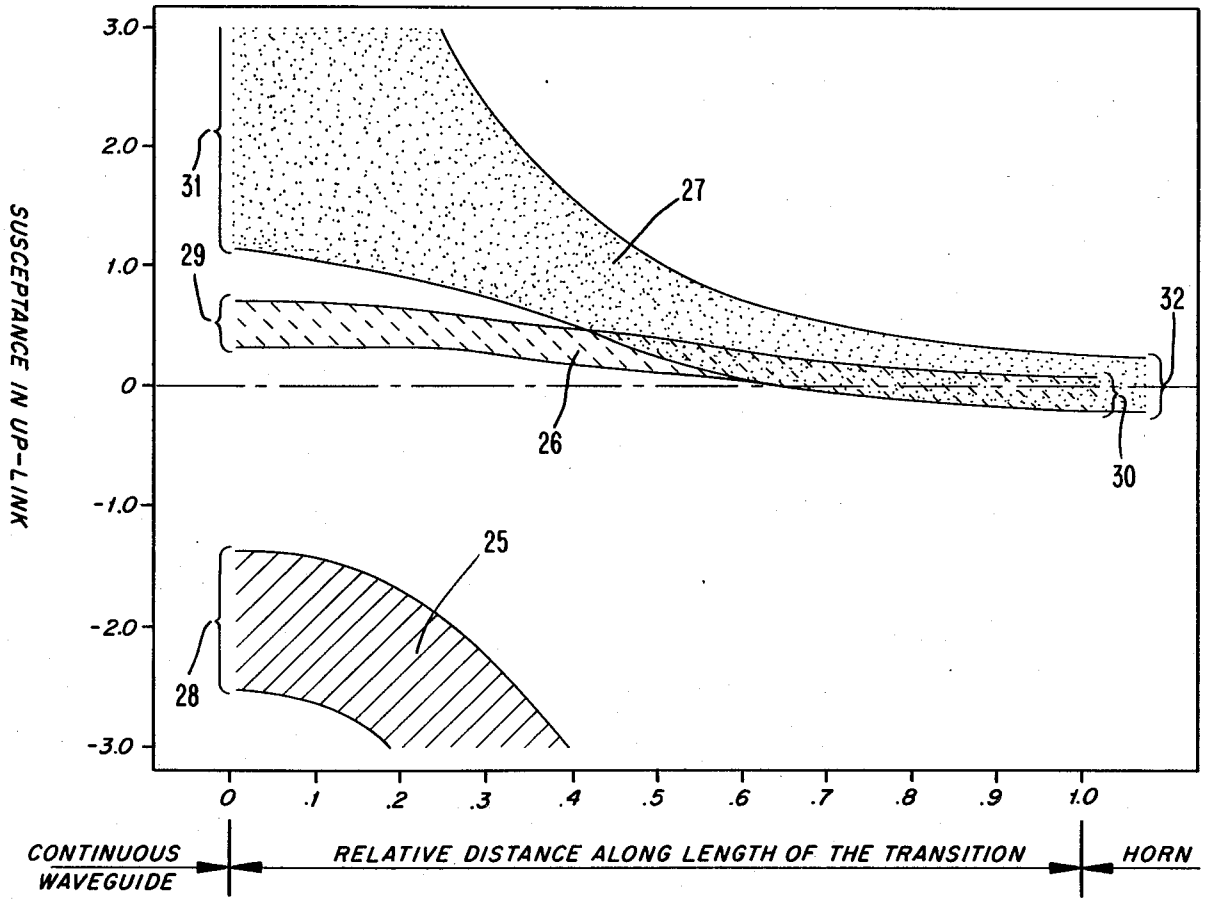
FIG. 3 shows the susceptance of the individual corrugation slots, which constitute the dual-depth corrugations, and the resultant simulated susceptance at the uplink along the length of the DDCT.

In order to explain the functioning of the DDCT, shown in FIG. 1, reference will be made to FIGS. 2 and 3 which show the susceptances (17,18) and (25,26) of the individual slots 14 and 15, constituting the dual-depth corrugations and the resultant simulated susceptances (19 and 27) along the length of the DDCT for the downlink and uplink, respectively. A high susceptance corrugation boundary condition is analogous to the natural boundary condition of a continuous waveguide and, therefore, the corrugations near the port 12 in the DDCT should be so configured that a high resultant susceptance boundary condition is simulated for both the links. This boundary condition is simulated in the present invention by means of an induced mutual resonance between the adjacent slots of different type in the dual-depth configuration near the port 12. The mutual resonance between the adjacent slots is achieved by the placement of susceptances of individual adjacent slots at comparable non zero magnitude but associated with opposite characteristics such as capacitive and inductive susceptances. For example, at the downlink, the deep slots 14 present a capacitive (+ve) susceptance 20 while the shallow slots 15 present an inductive (−ve) susceptance 21 near the port 12; as a consequence of which, the two susceptances combine and give rise to a mutual resonance to simulate the high susceptance 23. Next, in case of the uplink, the deep slots 14 present an inductive (−ve) susceptance 28 and the shallow slots 15 present a capacitive (+ve) susceptance 29 which mutually resonate to give, once again, the resultant high susceptance 31 at the port 12. Away from the port 12 as the opposite end, port 13, of the DDCT is approached, the corrugation boundary must be able to simulate a nearly zero susceptance in order to support the HE11 hybrid mode near balanced hybrid condition, which is the wanted mode for propagation in the corrugated horn. This susceptance boundary condition near the port 13 is conceived by an optimized depth of the slots in the dual-depth configuration so that a quarter wavelength self resonance for the individual slots of the two types is achieved at two different frequencies which are located, one each, in the two links under consideration. Specifically, for the example considered in FIGS. 1, 2 and 3, the depth of the slots 14 furnishes self resonant low susceptance condition 22 in the downlink and the optimized depth of the slots 15 provides self resonant low susceptance condition 30 in the uplink. Near the self resonant condition of a slot in a particular frequency band, the susceptance of the adjacent slot, which is under non-resonant condition, has less influence in determining the resultant susceptance of the corrugation boundary. Hence, near the port 13, the simulated boundary susceptances 24 and 32 for the downlink and uplink, respectively, are predominantly decided by the susceptances 22 and 30 which represent operation near quarter wavelength resonant condition for the slots 14 and 15, respectively. Along the length of the DDCT a gradual change in the configuration of the slots is achieved to allow for a continuous transition from the high susceptance boundary condition at port 12 to low susceptance boundary condition at port 13. In FIG. 2, the susceptances 17, 18 and 19 show the variation in the downlink for the individual slots 14, 15 and the resultant of the two combined, respectively. In FIG. 3, similarly, the susceptances 25, 26 and 27 show the variation in the uplink for the corresponding cases.

It is important to note from what has been described above that a satisfactory match can be achieved in a transition between a continuous and a corrugated circular waveguide by utilizing the principles of the above described invention for any two arbitrarily chosen frequency bands having a considerable separation between them, as long as the signals have a real phase propagation constant at all cross-section of the structure. However, in order that the excitation of spurious modes with high cross-polarization content be maintained at a low level, it is desirable that the DDCT is conceived under such cross-sectional dimensions between its two ends that propagation of these unwanted modes is not allowed as long as the near zero boundary susceptance condition is not fulfilled in the particular frequency band under consideration. When this condition is applied in conjunction with the requirement for low return loss characteristics, the principles of the present invention greatly facilitate in configuring a DDCT with efficient launching characteristics; since, in this case it is possible to obtain good return loss at two frequency bands even while one of the bands propagates signals with very low phase propagation constant. A situation of this nature arises often in the design of the feed horn launchers for operation in two bands with wide separation and where low levels of spurious mode excitation must, also, be maintained.

We claim:

1. In a transition device operable in a first frequency band and a second, distinctly different frequency band comprising a waveguide having first and second ports and having a tapered interior boundary wall containing alternately positioned first and second type slots of distinct relative configuration aligned transverse to the axis of said waveguide, the improvement comprising: said first and second type slots each configured near said first port to have (i) respective first and second susceptances for signals in said first frequency band, which first and second susceptances are each non-zero and substantially equal in magnitude, with one of said first and second susceptances being capacitive and the other being inductive, and (ii) respective third and fourth susceptances for signals in said second, distinctly different frequency band, which third and fourth susceptances are each non-zero and substantially equal in magnitude, with one of said third and fourth susceptances being capacitive and the other being inductive, such that said first and second susceptances, in combination, and said third and fourth susceptances, in combination, provide respective and simultaneous high susceptance mutual resonance conditions between adjacent ones of said first and second type slots for said first and second frequency bands as are required for simultaneous matching of said device with a continuous waveguide at said first port, for signals in said first and second frequency bands.

2. A transition device of claim 1 wherein said interior boundary wall is circular.

3. A transition device of claim 1 wherein said first slots are deeper than said second slots.

4. A transition device of claim 2 wherein said first slots are deeper than said second slots.

5. A transition device of claim 3 wherein said interior boundary wall is circular and has a smaller diameter at said first port than at said second port.

6. A transition device of claim 1, 2, 3, 4 or 5 wherein said first type slots, near said first port, are configured to have said first susceptance capacitive for signals in said first frequency band and to have said third susceptance inductive for signals in said second frequency band, and said second type slots, near said first port, are configured to have said second susceptance inductive for signals in said first frequency band and to have fourth susceptance capacitive for signals in said second frequency band.

7. A transition device of claim 6 wherein each of said first and second type slots has an independent rate of change in their configurations, starting near said first port and continuing toward said second port, to gradually suppress said mutual resonance conditions between adjacent slots and to achieve, at a first location in said waveguide remote from said first port, a quarter wavelength self-resonance boundary condition for said first type slots for signals in said first frequency band and, at a second location in said waveguide remote from said first port, to achieve a quarter wavelength self-resonance boundary condition for said second type slots for signals in said second frequency band to support, in said first and second slots respectively at said first and second locations, a balanced hybrid mode for signals in said respective frequency bands.

8. A transition device of claim 7 wherein the configuration of said first type slots remains constant from said first location of said waveguide to said second port and said configuration of said second type slots remains constant from said second location of said waveguide to said second port.

9. A transition device of claim 8 wherein said first and second slots become progressively less deep from said first port to said first and second locations, respectively.

* * * * *